United States Patent [19]

Pherigo

[11] Patent Number: 5,036,889

[45] Date of Patent: Aug. 6, 1991

[54] TUBE WITH FLIP-TOP CAP

[75] Inventor: Douglas E. Pherigo, Loves Park, Ill.

[73] Assignee: J. L. Clark, Inc., Rockford, Ill.

[21] Appl. No.: 335,702

[22] Filed: Apr. 10, 1989

[51] Int. Cl.[5] ..... F16L 55/16; B65D 35/08

[52] U.S. Cl. ..... 138/89; 222/107

[58] Field of Search ..... 138/89, 96 R, 96 T; 222/107, 541; 220/337, 339

[56] References Cited

U.S. PATENT DOCUMENTS

| | | | |
|---|---|---|---|
| 2,690,861 | 10/1954 | Tupper | 220/339 |
| 2,975,947 | 3/1961 | Pellett | 138/89 |
| 3,604,585 | 9/1971 | Towns . | |
| 3,675,812 | 7/1972 | Foster | 220/337 |
| 3,773,205 | 11/1973 | Keeler et al. . | |
| 3,807,457 | 4/1974 | Logsoon . | |
| 4,132,331 | 1/1979 | Mägerle | 222/107 |
| 4,193,519 | 3/1980 | Dubach et al. . | |
| 4,402,435 | 9/1983 | Libit . | |
| 4,448,829 | 5/1984 | Köhler | 222/107 |
| 4,548,338 | 10/1985 | Sanders | 222/107 |
| 4,568,001 | 2/1986 | Sanders | 222/107 |
| 4,711,363 | 12/1987 | Marino . | |

FOREIGN PATENT DOCUMENTS

| | | | |
|---|---|---|---|
| 296938 | 2/1954 | Switzerland | 220/339 |
| 674694 | 6/1952 | United Kingdom | 220/339 |

*Primary Examiner*—James E. Bryant, III

*Attorney, Agent, or Firm*—Leydig, Voit & Mayer

[57] ABSTRACT

A tube having a tube body made of laminations of plastic and metal foil and formed with an integral frustoconical breast. A plastic fitment with a frustoconical skirt is telescoped with and is bonded to the breast and includes an integral cap which is adapted to be swung between open and closed positions.

7 Claims, 1 Drawing Sheet

TUBE WITH FLIP-TOP CAP

BACKGROUND OF THE INVENTION

This invention relates to a collapsible tube and, more particularly, to a collapsible tube which is made at least in part of plastic.

Such tubes generally fall into two categories. The most popular in the dentrifice market is a laminate tube in which a lamination of several materials (e.g., plastic-metal-plastic) in sheet form is rolled into a tube and is longitudinally seamed. A plastic shoulder or breast with a threaded neck then is welded to the tube and provides a support for a closure. The closure may be either a simple screw-on cap or may be a screw-on fitment with a flip-top cap. In either case, the overall unit consists of three components which must be assembled with one another.

The other popular type of plastic tube is injection molded from plastic and includes an integral breast with a threaded neck for supporting a closure. While a unit of this type has only two components, the plastic does not "deaden" when squeezed and thus a single layer tube is not as acceptable as a laminate tube for dispensing some products such as dentrifices.

SUMMARY OF THE INVENTION

The general aim of the present invention is to provide a new and comparatively inexpensive laminate tube which requires only two components, namely, the tube itself and a fitment which carries a closure.

A more detailed object of the invention is to achieve the foregoing by providing a laminate tube having an integral breast and having a plastic fitment secured to the breast and supporting an integral flip-top cap.

The invention also resides in the unique shape of the breast and the fitment and in the construction of the flip-top cap to establish a good seal with the fitment.

These and other objects and advantages of the invention will become more apparent from the following detailed description when taken in conjunction with the accompanying drawings.

DETAILED DESCRIPTION OF THE PREFERRED EMBODIMENT

Figure 1:
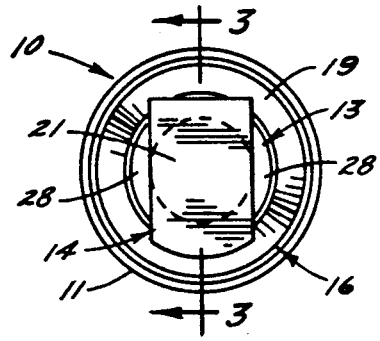
FIG. 1 is a top plan view of a new and improved tube incorporating the unique features of the present invention.

As shown in the drawings for purposes of illustration, the invention is embodied in a collapsible tube 10 for holding and dispensing a flowable product such as toothpaste. The tube includes an elongated cylindrical body 11 which is made by rolling a sheet into a tubular form and then seaming the sheet along its adjacent edges. In this instance, the sheet is a lamination of different materials. By way of example, the sheet may comprise layers of aluminum foil and paper sandwiched between layers of plastic such as polyethylene. By virtue of the aluminum foil, the tube body 11 has a deadening characteristic meaning that the body tends to stay flat when squeezed and does not spring back to its original condition. A laminate tube of this type assimilates the squeeze characteristics of a metal tube and is favored for the packaging of certain products.

Figure 3:
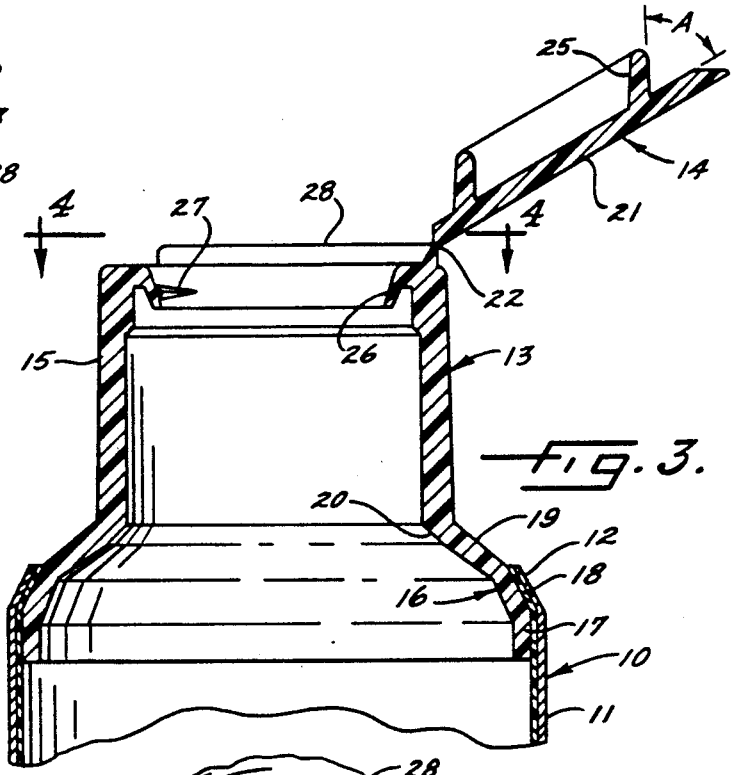
FIG. 3 is an enlarged cross-section taken substantially along the line 3—3 of FIG. 1 and shows the cap of the fitment in an open position.

In accordance with the present invention, the laminate tube body 11 is formed with an integral breast 12 (FIG. 3) which is bonded to a plastic closure fitment 13 having an integral flip-top cap 14. With this arrangement, the overall tube unit 10 consists of only two components so as to reduce the cost of manufacturing and assembling the unit.

More specifically, the breast 12 of the tube 10 consists of a frustoconical section (see FIG. 3) which is integral with a cylindrical section defined by one end (e.g., the upper end) of the tube body 11. The frustoconical section 12 tapers inwardly upon progressing upwardly and its portion of smallest diameter defines the dispensing end of the body. The frustoconical section is formed by crimping the end portion of the body 11 inwardly after the laminated sheet has been rolled and seamed.

The closure fitment 13 is of one-piece construction and is molded of polyethylene or other suitable plastic. The upper end portion of the fitment is defined by a tubular neck 15 whose inner side if substantially cylindrical. Formed integrally with and depending from the neck is an annular skirt 16.

In keeping with the invention, the skirt 16 is complementary in size and shape to the upper end portion of the tube body 11 and to the breast 12. Thus, the lower end portion 17 of the skirt is a cylindrical segment having an outermost side which is sized to telescope snugly into the cylindrical innermost side of the upper end portion of the body 11. Immediately above the lower end segment 17, the skirt 16 is formed with a frustoconical segment 18 of the same slope as the breast 12 and having an outermost side of the telescoped snugly into the innermost side of the breast. The outermost sides of the segments 17 and 18 are bonded tightly to the innermost sides of the body 11 and the breast 12, respectively, with the bonding preferably being effected by induction welding. As shown most clearly in FIG. 3, the outermost side of the breast is fully exposed.

The skirt 16 is completed by a second frustoconical segment 19 located between the neck 15 and the frustoconical segment 18. The segment 19 is of shallower slope than the segment 18 and enables the neck 15 to be of relatively small diameter and to be positioned in close proximity to the breast 12. Along its inner side and upper end, the segment 19 is chamfered as indicated at 20 in FIG. 3 to receive a tamper-evident insert (not shown) for sealing the product in the tube body 11.

Figure 2:
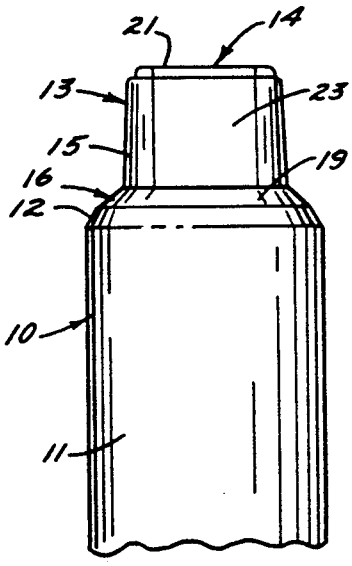
FIG. 2 is a fragmentary elevational view of the tube.
Figure 4:
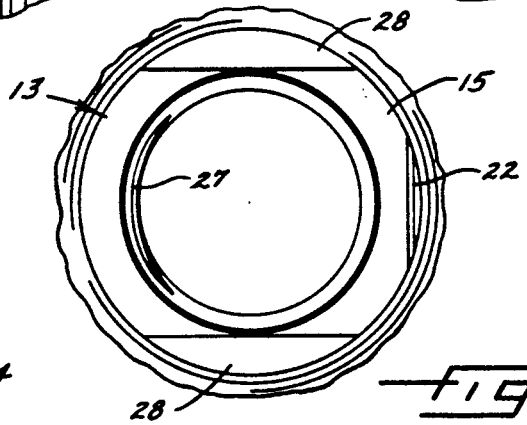
FIG. 4 is a fragmentary top plan view of the fitment as seen along the line 4—4 of FIG. 3.
Figure 5:
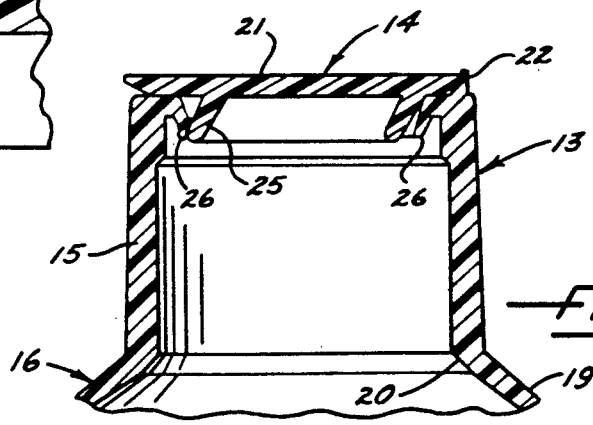
FIG. 5 is a view similar to FIG. 3 but shows the cap of the fitment in a closed position.

Further in keeping with the invention, the cap 14 is integral with the neck 15 and is hinged on the neck to swing between an open position (FIG. 3) and a closed position (FIG. 5). For this purpose, the cap includes a flat plate 21 (FIG. 3) having one margin which is connected to the upper end of the neck 15 by a living hinge 22 (FIGS. 3 and 4) defined by a straight upwardly opening groove formed in and extending chordwise of the neck. That portion of the outside of the neck underlying the hinge is flat and vertical as indicated at 23 in FIG. 2 while the remainder of the outside of the neck is arcuate.

Figure 6:
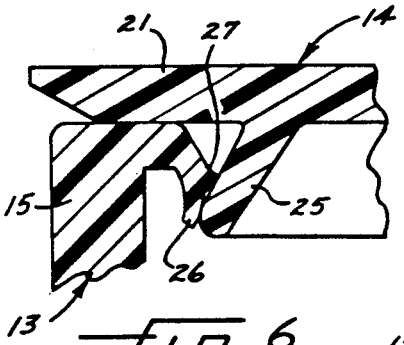
FIG. 6 is an enlarged view of certain parts shown in FIG. 5.

Formed integrally with and depending from the underside of the plate 21 is an annular rib 25 (FIGS. 3, 5 and 6) which defines a closure plug. The rib is adapted to coact with a fin 26 in the neck 15 to seal the neck when the cap 14 is in its closed position. The fin is circular, is spaced radially inwardly from the inner side of the neck, and tapers upon progressing downwardly. When the cap 14 is swung downwardly about the hinge 22 toward its closed position, the rib 25 deflects the fin 26 as shown in FIG. 6 and seals against the fin in order to establish a good seal between the cap and the neck. A nib 27 extending around a portion of the inner side of the fin opposite the hinge engages the rib to releasably hold the cap in its closed position. When the cap is closed, the upper side of the plate 21 lies flush with a pair of upstanding ledges 28 (FIGS. 3 and 4) located on opposite sides of the cap and extending transversely of the hinge 22, the ledges being formed on the upper end of the neck 15. A thumbnail may be inserted between the ledges and beneath the free edge of the plate to facilitate lifting the cap to its open position.

The cap 14 is molded while in an inclined position (see FIG. 3) as disclosed substantially in Foster U.S. Pat. No. 3,675,812 and is first closed after the fitment 13 has been ejected from the molding dies. To facilitate stripping of the dies from the cap, the rib is inclined at an acute angle A (FIG. 3) of about 60 degrees relative to the underside of the plate 21.

From the foregoing, it will be apparent that the present invention brings to the art a new and improved tube 10 in which the tube body 11 is laminated and is secured directly to the fitment 13 having the integral flip-top cap 14. Because the tube consists only of two components, it may be manufactured at comparatively low cost.

I claim:

1. A collapsible tube comprising a body made at least partially of plastic and having an end portion defined by an integral and substantially frustoconical breast, said breast having an innermost side and an outermost side, and a one-piece plastic closure for said body, said closure comprising a tubular neck having first and second open ends, a skirt formed integrally with said first end of said neck, said skirt being substantially frustoconical and being complementary in size and shape with said breast, said skirt having an innermost side and an outermost side, said breast being telescoped snugly with said skirt and being bonded to said skirt with said innermost side of said breast disposed in face-to-face relation with said outermost side of said skirt, said outermost side of said breast being completely exposed from one end of said frustoconical breast to the other end of said frustoconical breast, and a cap for closing said second end of said neck, said cap being formed integrally with said neck and being swingable between positions opening and closing said neck.

2. A collapsible tube as defined in claim 1 in which said skirt is bonded to said breast by an induction weld.

3. A collapsible tube as defined in claim 1 in which said skirt is defined by a series of interconnected plastic segments of various slopes, said skirt having a free end portion defined by a cylindrical segment, the immediately adjacent portion of said skirt being defined by a relatively steep frustoconical segment, and the next adjacent portion of said skirt being defined by a shallower frustoconical segment.

4. A collapsible tube as defined in claim 1 in which said neck includes an inner side, an annular sealing fin formed around the inner side of said neck adjacent the second end thereof, said fin being spaced radially inwardly from the inner side of said neck, extending toward the first end of the neck, and tapering in diameter upon progressing toward said first end, and an annular rib on said cap and positioned to telescope into said second end of said neck and seal against said fin which said cap is closed.

5. A collapsible tube as defined in claim 4 in which said cap comprises a substantially flat plate, said rib projecting from one side of said plate.

6. A collapsible tube as defined in claim 5 in which said rib is inclined at an acute angle relative to said plate.

7. A collapsible tube comprising a laminate body having a plastic inner layer and having an end portion, said end portion having a cylindrical section and having an immediately adjacent substantially frustoconical section whose end of smaller diameter defines one end of said body, said body having an innermost side and an outermost side, and a one-piece plastic closure for closing the end of said body, said closure comprising a tubular and substantially cylindrical neck having first and second open ends, a skirt formed integrally with said first end of said neck and having an innermost side and an outermost side, said skirt having a free end defining a cylindrical segment and having a substantially frustoconical segment immediately adjacent said cylindrical segment, said cylindrical and frustoconical segments of said skirt being complementary in size and shape with the cylindrical and frustoconical sections, respectively, of said body and being telescoped snugly therein with the outermost side of said skirt disposed in face-to-face engagement with the innermost side of said body, the outermost side of said body being completely exposed from one side of said frustoconical section to the other end of said frustoconical section, a weld integrally bonding the cylindrical and frustoconical segments of said skirt to the cylindrical and frustoconical sections, respectively, of said body, and a cap for closing said second end of said neck, said cap being formed integrally with said neck and being swingable between positions opening and closing said neck.

* * * * *